US005536118A

United States Patent [19]

Schmidt et al.

[11] Patent Number: 5,536,118

[45] Date of Patent: Jul. 16, 1996

[54] APPARATUS FOR TRANSFERRING ROD-SHAPED ARTICLES FROM A SUPPLY INTO A PNEUMATIC CONVEYOR

[75] Inventors: Hans-Herbert Schmidt, Hamburg; Rudolf Bostelmann, Geesthacht, both of Germany

[73] Assignee: Hauni Maschinenbau AG, Hamburg, Germany

[21] Appl. No.: 284,811

[22] Filed: Aug. 2, 1994

[30] Foreign Application Priority Data

Aug. 30, 1993 [DE] Germany ..... 43 29 084.1

[51] Int. Cl.[6] ..... B65G 53/48

[52] U.S. Cl. ..... 406/68; 406/63; 198/471.1; 131/94; 221/263; 221/278

[58] Field of Search ..... 406/68, 63, 64, 406/67, 72; 198/443, 471.1; 221/211, 263, 278; 222/636; 131/94, 88

[56] References Cited

U.S. PATENT DOCUMENTS

| | | | |
|---|---|---|---|
| 3,827,757 | 8/1974 | Heitmann et al. | 406/67 |
| 4,287,981 | 9/1981 | Allen et al. | 198/471.1 |
| 4,780,028 | 10/1988 | McLemore | 406/68 |
| 4,883,078 | 11/1989 | Hirose et al. | 131/94 |

FOREIGN PATENT DOCUMENTS

| | | | |
|---|---|---|---|
| 678003 | 8/1979 | U.S.S.R. | 406/68 |
| 1512882 | 10/1989 | U.S.S.R. | 406/68 |
| 774980 | 5/1957 | United Kingdom | 406/67 |

*Primary Examiner*—Gary C. Hoge
*Attorney, Agent, or Firm*—Darby & Darby

[57] ABSTRACT

Apparatus for transferring rod-shaped articles from the outlet of a magazine for parallel articles into the inlet of a pneumatic conveyor wherein the articles are moved in the direction of their longitudinal axes comprises a rotary drum-shaped conveyor having a peripheral surface provided with axially parallel flutes. When the rotary conveyor is driven, its flutes advance seriatim past the outlet of the magazine to accept discrete articles which are thereupon moved sideways toward alignment with the inlet of the pneumatic conveyor. A pneumatic ejector system is utilized to propel successive articles from their flutes into the pneumatic conveyor. The apparatus employs a hood having a concave surface which is complementary to a portion of the peripheral surface of the rotary conveyor. A median portion of the concave surface is maintained close to but still out of contact with the adjacent portion of the peripheral surface by two stationary sealing members which are adjacent to but still out of contact with the end faces of the rotary conveyor. The hood is movable between a first position in which its concave surface abuts the sealing members but is out of contact with the peripheral surface of the rotary conveyor and a second position in which the hood affords access to the article propelling station.

18 Claims, 3 Drawing Sheets

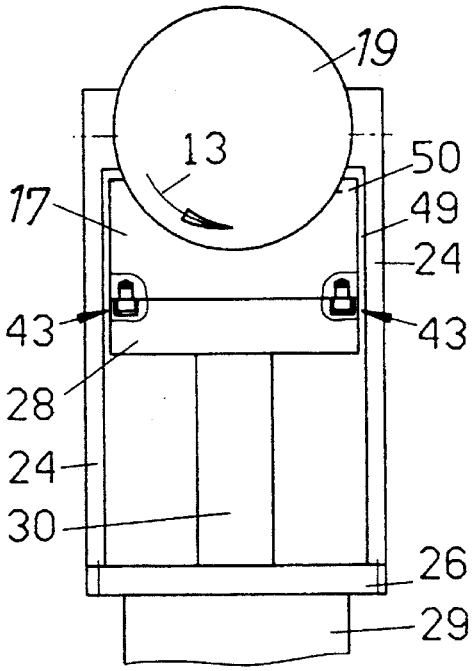
Fig.2
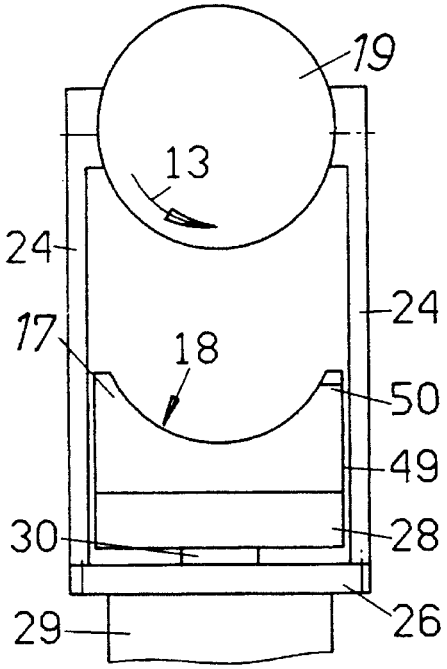
Fig.4
Fig.7
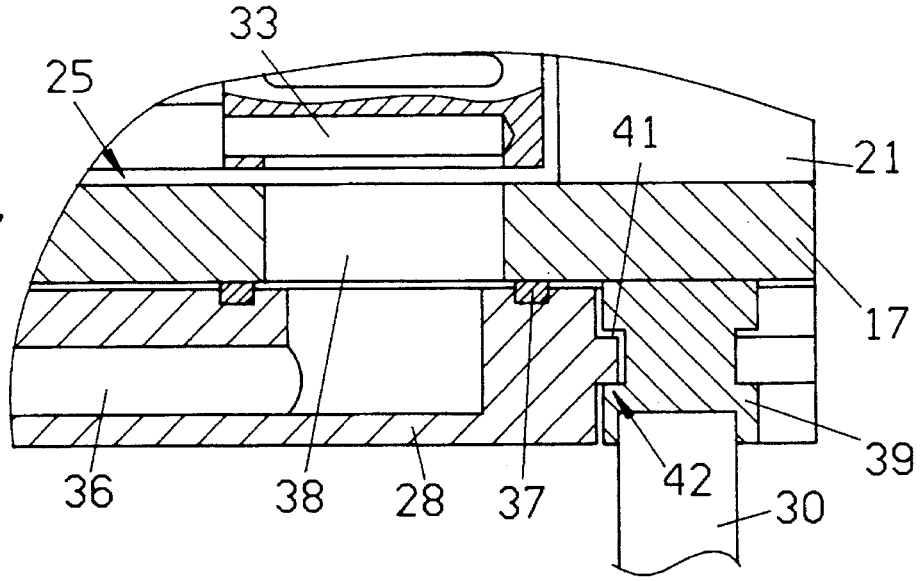

APPARATUS FOR TRANSFERRING ROD-SHAPED ARTICLES FROM A SUPPLY INTO A PNEUMATIC CONVEYOR

BACKGROUND OF THE INVENTION

The invention relates to improvements in apparatus for transporting rod-shaped articles, such as plain or filter cigarettes, cigars or cigarillos, filter rod sections and other rod-shaped articles of the tobacco processing industry. More particularly, the invention relates to improvements in apparatus for transferring rod-shaped articles from a source of supply of substantially parallel articles into the inlet of a pneumatic conveyor wherein the articles form a single file of articles.

U.S. Pat. No. 3,827,757 discloses an apparatus wherein a rotary drum-shaped conveyor is employed to accept a series of rod-shaped articles from the outlet of a magazine and advances successive articles of the series to a position of alignment with the inlet of a pneumatic conveyor. A pneumatic ejector system is employed to propel successive rod-shaped articles from their flutes at the periphery of the rotary conveyor into the inlet of the pneumatic conveyor. The patented apparatus further comprises a stationary block-shaped sealing member which is installed at the ejecting station to engage the periphery of the rotary conveyor in the region where the articles are propelled into the inlet of the pneumatic conveyor. The purpose of the sealing member is to ensure that the blasts or streams of compressed air which are furnished by the pneumatic ejector system can propel successive articles into the inlet of the pneumatic conveyor at a relatively high frequency. Furthermore, the patented apparatus employs a mechanism which can move the sealing member away from the rotary conveyor in order to afford access to the station for propulsion of successive articles of the series into the pneumatic conveyor. This renders it possible to remove a damaged or misaligned article within a relatively short interval of time.

A drawback of the patented apparatus is that the rotary conveyor is frictionally engaged by the sealing member. This can generate substantial amounts of heat and the abutting surfaces of the rotary conveyor and of the sealing member are subject to extensive wear. Furthermore, the output of the patented apparatus is limited, i.e., the upper limit of the frequency at which successive articles are propelled into the pneumatic conveyor is relatively low.

OBJECTS OF THE INVENTION

An object of the invention is to provide an apparatus which can transfer rod-shaped articles from a source into a pneumatic conveyor in such a way that the wear due to friction between the parts which rotate and/or otherwise move relative to each other is considerably less than in heretofore known apparatus.

Another object of the invention is to provide a novel and improved combination of parts at the station where the rod-shaped articles of a series of such articles are propelled into the pneumatic conveyor.

A further object of the invention is to provide novel and improved means for regulating the flow of air into and from receptacles which form part of or are carried by the rotary conveyor to advance successive articles of the series sideways from the source of supply to the inlet of the pneumatic conveyor.

An additional object of the invention is to provide novel and improved means for affording access to the transfer station between the rotary conveyor and the pneumatic conveyor.

Still another object of the invention is to provide novel and improved means for moving and guiding a sealing member relative to the rotary conveyor of the above outlined apparatus.

A further object of the invention is to provide a novel and improved method of sealing the transfer station between the rotary and pneumatic conveyors to an extent which is necessary to permit the transfer of rod-shaped articles into the inlet of a pneumatic conveyor at a high frequency and without causing any, or any appreciable, wear upon the rotary conveyor.

Another object of the invention is to provide an apparatus which constitutes an improvement over and a further development of the apparatus disclosed in the U.S. Pat. No. 3,827,757.

An additional object of the invention is to provide an apparatus which can reliably transfer parallel rod-shaped articles from a source of supply into a pneumatic conveyor at a frequency considerably higher than that achievable with heretofore known apparatus.

SUMMARY OF THE INVENTION

The invention is embodied in an apparatus for transferring rod-shaped articles (such as filter rod sections or other rod-shaped articles of the tobacco processing industry) from a source of supply of parallel articles (e.g., a magazine having an outlet at the bottom part thereof) into the inlet of a pneumatic conveyor. The improved apparatus comprises a rotary second conveyor which is rotatable about a predetermined axis and has a peripheral surface provided with receptacles (hereinafter called flutes for short) parallel to the axis and dimensioned to receive discrete articles, means for rotating the second conveyor in a predetermined direction to thus repeatedly advance successive flutes between a first station where the flutes receive discrete articles from the outlet of the source and a second station where the articles register with the inlet of the pneumatic conveyor (i.e., successive flutes are rotated unidirectionally to advance from the first station to the second station, thereupon back to the first station, and so forth), means for propelling articles lengthwise from successive flutes arriving at the second station into the inlet of the pneumatic conveyor, a hood or shroud having a second surface which is complementary to the peripheral surface of the rotary conveyor, and means for moving the hood between a first position in which the second surface is closely adjacent to but still out of contact with the adjacent portion of the peripheral surface at the second station and a second position in which the hood affords access to the second station. For example, the second surface can be configurated and dimensioned in such a way that it is closely adjacent to but still out of actual contact with a portion of the peripheral surface extending along an arc of slightly less or even considerably less than 180°.

The axis of the rotary conveyor is or can be at least substantially horizontal, and the first station is preferably disposed at a level above the second station. Furthermore, the peripheral surface is preferably located at a level above the second surface, at least in the second position of the hood.

The means for rotating the second conveyor preferably comprises a shaft which is coaxial with and carries the second conveyor. The latter has first and second end faces located in planes which are normal to the common axis of the shaft and the second conveyor and flank the peripheral surface and the flutes therein. Such apparatus preferably further comprises first and second stationary sealing members which are closely adjacent to but still out of contact with the respective end faces of the rotary second conveyor. The shaft of the means for rotating the second conveyor is journalled in at least one of the sealing members, and the second surface has portions which sealingly engage the the sealing members, at least in the first position of the hood. The second surface is a concave surface and each of the sealing members has a convex third surface which is engaged by the respective portion of the second surface in the first position of the hood. The second and third surfaces preferably have at least substantially identical radii of curvature, and the radius of curvature of the peripheral surface of the rotary second conveyor is smaller than the radius of curvature of the second surface.

The means for moving the hood between the first and second positions preferably comprises at least one piston which is movable substantially radially of the axis of the rotary conveyor to bias the aforementioned portions of the second surface against the sealing members in the first position of the hood. The piston or pistons are disposed between the two sealing members, as seen in the axial direction of the rotary conveyor. If the moving means comprises two pistons, each of these pistons can be installed at the same distance from the neighboring sealing member.

The means for propelling successive articles into the inlet of the second conveyor preferably comprises a pneumatic ejector, and the aforedescribed moving means can further comprise a carrier which is interposed between the hood and the piston or pistons. At least a portion of the ejector can be disposed in the carrier which latter supports and transmits the movements of the piston or pistons to the hood. Such apparatus preferably further comprises elastic sealing means (e.g., one or more O-rings) interposed between the hood and the carrier. Still further, the aforedescribed moving means can also comprise first and second entraining members one of which is provided on (e.g., on a head of) the at least one piston and the other of which is provided on the carrier. The first entraining member extends with clearance into the second entraining member.

The apparatus can further comprise a stationary support or base and means for fixedly securing the sealing members to the support. If the aforementioned means for moving the hood between the first and second positions comprises one or more pistons, each such piston preferably forms part of a discrete fluid-operated (e.g., pneumatic) motor which is mounted on the support. For example, each motor can comprise a cylinder which is mounted on the support and a piston which is reciprocable relative to the respective cylinder and is coupled to the carrier by the aforediscussed entraining members.

The means for moving the hood preferably further comprises at least one guide which is provided on the support and establishes for the carrier and the hood thereon a predetermined path for movements of the carrier and hood toward and away from the second station. Such path is or can be an at least substantially vertical path. The guide or guides can be said to constitute means for confining the hood to movements along a single (preferably at least substantially vertical) path.

The means for moving the hood can further comprise means for centering the hood relative to the aforementioned carrier, i.e., for maintaining the hood in a predetermined position relative to the carrier.

One of the aforementioned sealing members at the respective end face of the rotary second conveyor preferably carries or defines the inlet of the pneumatic conveyor. Such apparatus can further comprise a suitably inclined ramp which can be provided in the hood to guide successive articles arriving at the second station into the inlet in the first position of the hood. The ramp can constitute a separately produced component which is recessed into the (second) surface of the hood.

As mentioned above, the means for rotating the rotary second conveyor is constructed and assembled to rotate the second conveyor in a predetermined direction. When the hood is maintained in the first position, its (second) surface defines with the peripheral surface of the rotary conveyor an arcuate channel having an upstream end (located upstream of the second station (as seen in the direction of rotation of the second conveyor), and a downstream end (located downstream of the second station but upstream of the first station, as seen in the direction of rotation of the second conveyor) which is preferably enlarged to permit air (such as compressed air which was utilized to propel articles into the inlet of the pneumatic conveyor) to escape from successive (emptied) flutes advancing from the second station back to the first station.

One presently preferred use of the improved apparatus is to transfer filter rod sections sideways from a magazine into the inlet of a pneumatic conveyor wherein successive transferred articles are advanced lengthwise, e.g., to a filter tipping machine or into storage.

The rotary second conveyor can comprise means for pneumatically attracting rod-shaped articles in the flutes which advance from the first station toward the second station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 2 is a fragmentary end elevational view of the apparatus, with the hood again shown in the first position;

FIG. 4 is a view similar to that of FIG. 2 but with the hood shown in the second position;

FIG. 7 is an enlarged view of a detail within the phantom-line circle A in FIG. 5.

DESCRIPTION OF PREFERRED EMBODIMENTS

Figure 1:
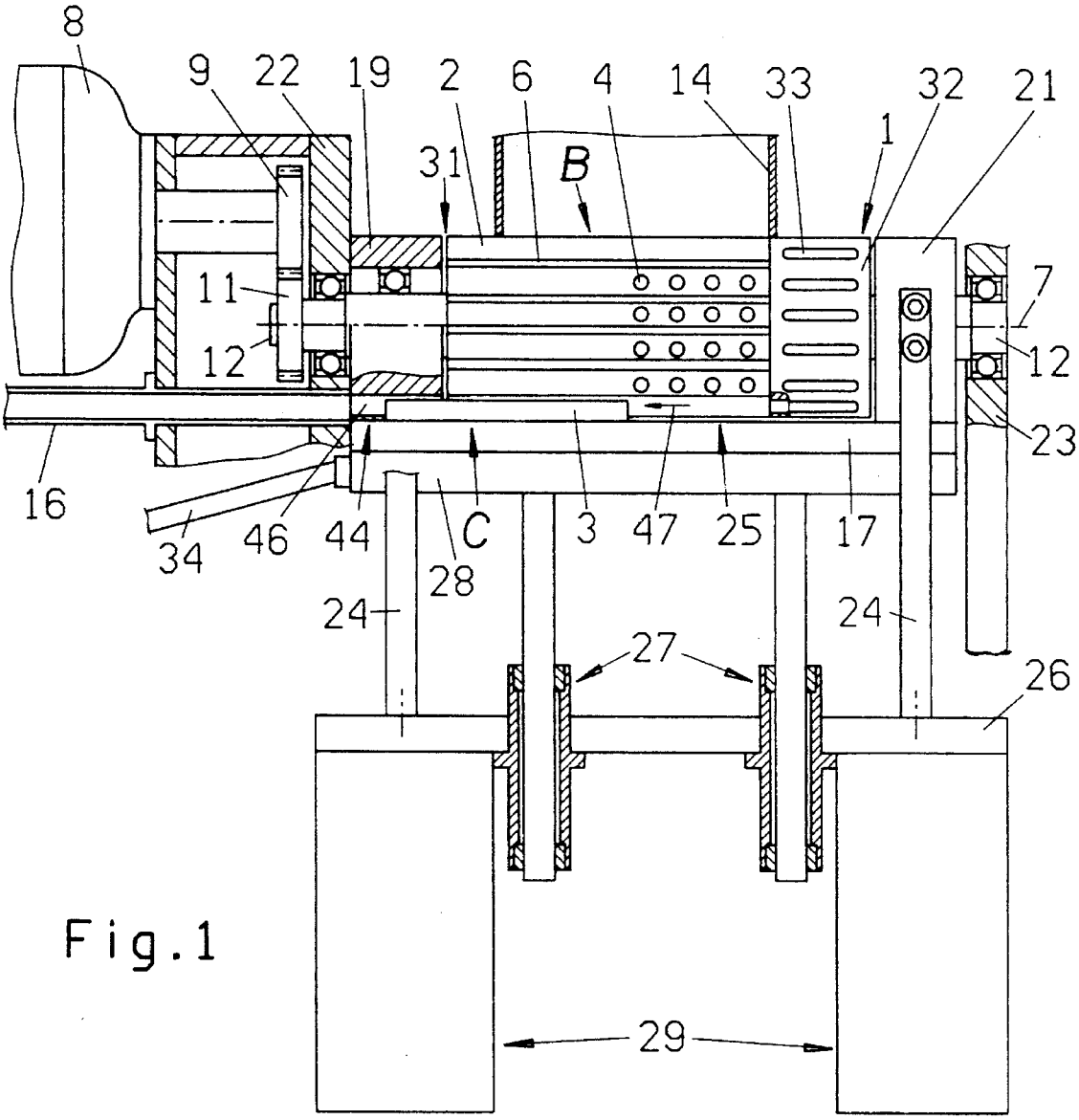
FIG. 1 is a schematic partly side elevational and partly vertical sectional view of an apparatus which embodies one form of the instant invention, the hood being shown in the first position, i.e., at the station where the articles are propelled into the inlet of the pneumatic conveyor.
Figure 6:
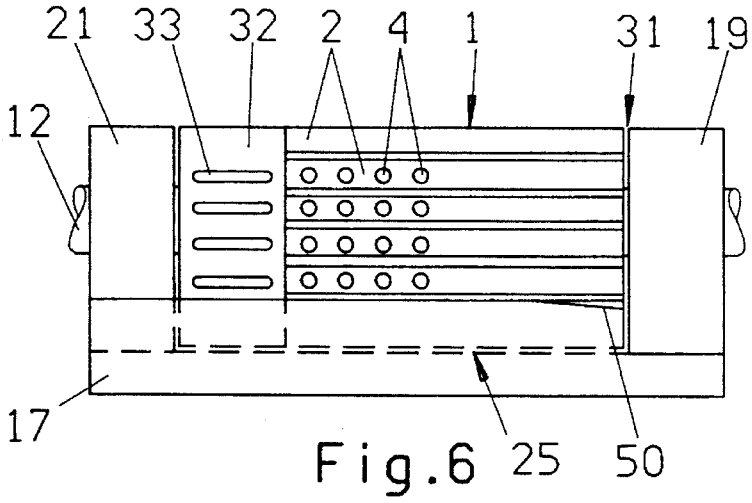
FIG. 6 is a rear elevational view of the rotary conveyor, of the two sealing members and of the hood which is shown in the first position.

The apparatus which is shown in FIGS. 1 to 7 comprises a drum-shaped conveyor 1 which is rotatable about a horizontal axis 7 and the peripheral surface 6 of which is provided with a set of axially parallel elongated equidistant flutes 2 for discrete rod-shaped articles 3, e.g., filter rod sections of multiple unit length. The bottom portions of the flutes 2 communicate with rows of suction ports 4 forming part of means for pneumatically attracting articles 3 in the respective flutes to the conveyor 1 during transport of articles from a first station B to a second station C. The stations B and C are disposed diametrically opposite each other and the station B is located at a level above the station C. The flutes 2 are open radially outwardly so that they can receive discrete articles 3 from the outlet at the bottom of a magazine 14 which stores a supply of parallel articles.

The means for rotating the conveyor 1 in the direction of arrow 13 (see FIGS. 2 and 4) comprises a modular prime mover 8 here shown as an electric motor having an output shaft carrying a first gear 9 in mesh with a second gear 11 on the shaft 12 of the conveyor 1. As shown in FIG. 1, the motor 8 can be installed at a level above a pneumatic conveyor 16 having an inlet 46 at the station C. When the apparatus is in use, the conveyor 1 is driven continuously so that successive flutes 2 receive articles 3 during advancement past the outlet of the magazine 14 and transport the articles sideways (i.e., transversely of their length) from the station B to the station C where the articles are propelled into the inlet 46 of the pneumatic conveyor 16. The means for propelling articles 3 from the flutes 2 into the conveyor 16 comprises a pneumatic ejector including a flexible conduit 34 receiving compressed gaseous fluid (such as air) from a suitable source, not shown in the drawings and having a discharge end in communication with a bore or hole 36 (FIG. 5) provided in a carrier 28 for a hood or shroud 17. At least the major part of the pneumatic conveyor 16 is stationary but the carrier 28, and the hood 17 thereon, are movable up and down between a first or raised position shown in FIGS. 1, 2, 5, 6 and 7 and a second or lowered position shown in FIGS. 3 and 4.

The hood 17 is provided with a concave surface 18 which is complementary to a portion of the cylindrical peripheral surface 6 of the conveyor 1. The cylindrical peripheral surface 6 is composed of the top lands of axially parallel ribs which alternate with the flutes 2 in the circumferential direction of the conveyor 1.

The radius of curvature of the peripheral surface 6 of the rotary conveyor 1 is slightly smaller than the radius of curvature of the concave surface 18 of the hood but the centers of curvature of the two surfaces 6 and 18 are located on the axis 7. In accordance with a feature of the invention, the concave surface 18 is very closely adjacent to but remains out of contact with the adjacent portion of the peripheral surface 6 when the hood 17 is maintained in the first or raised position. The relatively narrow arcuate clearance or channel 25 between the surfaces 6 and 18 in the first position of the hood 17 is shown, exaggerated, in FIGS. 1 and 5–7. The establishment of such clearance or channel 25 is made possible by two stationary sealing members 19 and 21 which are adjacent to but out of actual contact with the adjacent end faces of the rotary conveyor 1. One of the two narrow clearances between the sealing members 19, 21 and the respective end faces of the conveyor 1 is denoted by the reference character 31 in each of FIGS. 1 and 5–7. The sealing members 19, 21 have convex peripheral surfaces which confront and are engaged by the adjacent portions of the concave surface 18 when the hood 17 is maintained in the first or raised position at the station C. The radii of curvature of the convex surfaces of the sealing members 19 and 21 are identical with the radii of curvature of the adjacent portions of the concave surface 18 so that the upward movement of the hood 17 and its carrier 28 from the second position of FIGS. 3 and 4 to the raised position at the station C is terminated at the exact instant when the median portion of the concave surface 18 and the adjacent portion of the peripheral surface 6 establish a clearance or channel 25 of requisite width, namely a width which suffices to ensure that the conveyor 1 can be rotated by the motor 8 without rubbing against the hood 17 at the station C. The centers of curvature of the aforediscussed convex surfaces of the sealing members 19 and 21 are located on the axis 7 of the conveyor 1 and its shaft 12 but the radii of curvature of the convex surfaces of the sealing members are slightly larger than the radius of the peripheral surface 6.

The end portions of the shaft 12 are journalled in suitable antifriction bearings in the two sealing members 19 and 21 (see FIG. 1) and one end portion of the shaft is further journalled in an antifriction bearing provided in a case 22 for the transmission including the gears 9 and 11 of the means for rotating the conveyor 1 in the direction of the arrow 13. The other end portion of the shaft 12 is journalled in an antifriction bearing provided in a stationary frame member 23 outwardly adjacent the sealing member 21. The sealing members 19, 21 are affixed to the upper ends of pairs of upright columns or legs 24 having lower ends secured to a stationary support or base 26 at a level below the carrier 28 for the hood 17. The support 26 further carries two upright guides 27 having vertically reciprocable plungers which are affixed to the underside of the carrier 28. The guides 27 confine the carrier 28, and hence the hood 17, to reciprocatory movements along a vertical path so that the hood 17 is properly located relative to the convex surfaces of the sealing members 19, 21 when it assumes the first or raised position in which its surface 18 and the adjacent portion of the peripheral surface 6 define the aforementioned clearance or channel 25.

The means for moving the hood 17 between the first and second positions includes the carrier 28 and two fluid-operated motors here shown as pneumatically operated cylinder and piston units each having a cylinder 29 at the underside of the support 26 and a piston 30 having a head 39 anchored with a certain amount of play, in the adjacent portion of the carrier 28. When the hood 17 assumes its raised first position, its concave surface 18 is close to but out of actual contact with the adjacent portion of the peripheral surface 6 of the conveyor 1. In addition, the surface 18 bears against the adjacent convex surfaces of the sealing members 19, 21 to thus further ensure that the sealing members and the neighboring end faces of the conveyor 1 define the narrow clearances 31, i.e., the conveyor 1 can be rotated by the motor 8 without contacting any of the stationary parts 17, 19, 21 at the station C.

Figure 5:
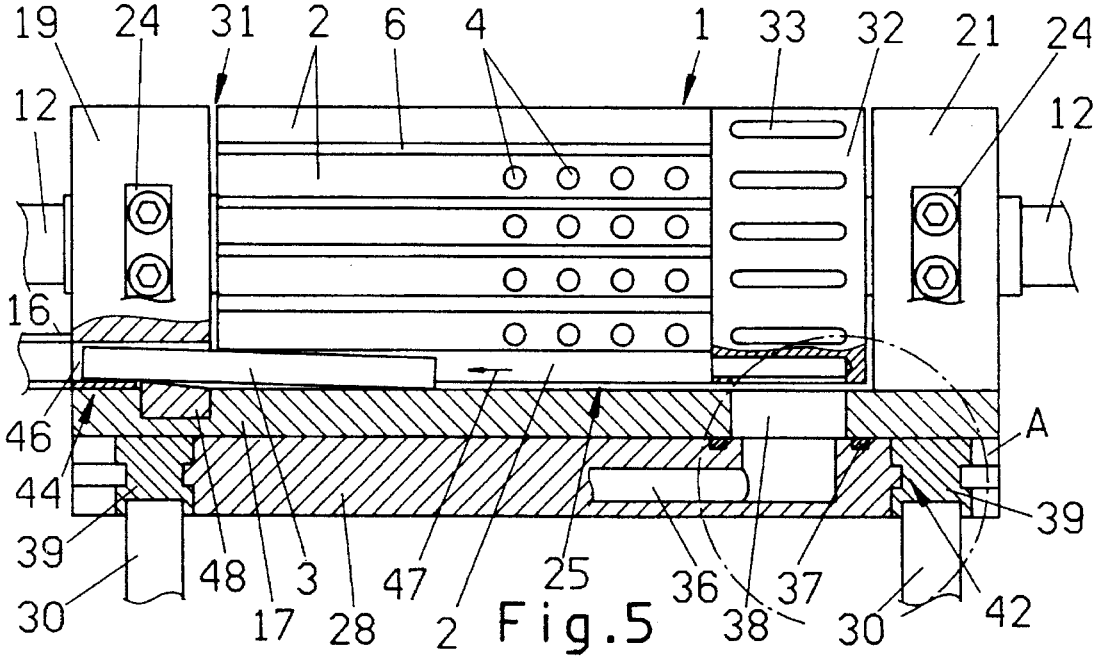
FIG. 5 is an enlarged partly side elevational and partly vertical sectional view of the structure shown in the upper portion of FIG. 1.

The bore or hole 36 constitutes that part of the pneumatic ejector for articles 3 which is disposed in (actually defined by) the carrier 28 for the hood 17. The pneumatic ejector or propelling means of the improved apparatus further includes an annulus of elongated slots 33 which are parallel with the axis 7 of the conveyor 1 and are provided in that end portion (32) of the conveyor 1 which extends beyond the outlet of the magazine 14 in a direction toward but short of the stationary sealing member 21. Each slot 33 is aligned with one of the flutes 2 and successive slots 33 communicate with the discharge end of the bore or hole 36 of the carrier 28 when the respective flutes 2 (and the articles 3 therein) reach the station C. The discharge end of the bore or hole 36 in the carrier 28 actually communicates with an elongated slot 38 which is provided in the adjacent portion of the hood 17 and extends from the underside of the hood all the way into the concave surface 18. The aforementioned conduit 34 (which supplies compressed air to the bore or hole 36) is flexible or is otherwise mounted in such a way that its discharge end can share the reciprocatory movements of the carrier 28 between the station C and the second or lower position of the carrier and the hood 17 thereon. As can be seen in FIGS. 5 and 7, a sealing ring 37 (e.g., an O-ring) surrounds the discharge end of the bore or hole 36 in the upper side of the carrier 28.

The upper end portions or heads 39 of the pistons 30 cooperate with the adjacent portions of the carrier 28 in a manner as best shown in FIG. 7. The means 42 for entraining the carrier 28 in response to up or down movement of the pistons 30 comprises male entraining members on the carrier 28 and female entraining members in the heads 39 of the pistons 30. The male and female members define clearances 41 which provide room for some radial and axial movements of the heads 39 relative to the surrounding portions of the carrier 28. The upper end faces of the heads 39 of the pistons 30 abut the underside of the hood 17.

The means for accurately centering or positioning the hood 17 relative to the carrier 28 comprises pins 43 which are shown in FIG. 2. These pins permit some movements of the hood 17 relative to the carrier 28 so that the end portions of the concave surface 18 can lie flush against the adjacent convex surfaces of the sealing members 19, 21 when the carrier 28 maintains the hood in the first or raised position. In other words, the pins 43 enable the sealing members 19, 21 to accurately position the hood 17 in the raised or first position of FIGS. 1, 2 and 5 to 7 so that the median portion of the concave surface 18 and the adjacent portion of the peripheral surface 6 define the clearance or channel 25 which ensures that the conveyor 1 does not come into frictional engagement with the hood 17 when the apparatus is in use, i.e., when the conveyor 1 is driven by the motor 8 to transfer successive articles 3 from the outlet of the magazine 14 toward the station C.

The inlet 46 of the pneumatic conveyor 16 is provided in the sealing member 19, i.e., that sealing member which is nearer to the motor 8 and the conveyor 16 than the sealing member 21. The inlet 46 is a passage which is parallel to the axis 7 of the conveyor 1 and is in temporary alignment with successive articles 3 which reach the station C. In order to ensure predictable and reliable expulsion of successive articles 3 into the inlet 46 of the pneumatic conveyor 16, the apparatus further comprises a suitably configurated ramp 48 which, in the illustrated embodiment, is a separately produced part recessed into the concave surface 18 of the hood 17. The sloping upper side of the ramp 48 ensures unimpeded advancement of the leading ends of successive articles 3 on their way from the flutes 2 into the inlet 46. FIG. 5 shows that a sealing portion 44 in the inlet 46 of the conveyor 16 is not and cannot be engaged by the front end faces of successive articles 3 because the slope of the ramp 48 is such that it compensates for the difference between the levels of the central or lowermost part of the concave surface 18 and the bottom surface in the inlet 46. The arrow 47 denotes the direction of propulsion or expulsion of successive articles 3 from their flutes 2 into the inlet 46 of the pneumatic conveyor 16.

The downstream end of the arcuate channel or clearance 25 between the surfaces 6 and 18 is enlarged at 50 (see FIGS. 2, 4 and 6) in order to permit escape of compressed air filling the flutes 3 on their way from the station C back toward the station B so that the suction ports 4 can attract articles 3 which enter the oncoming flutes 2 at the station B. The enlarged portion 50 of the channel 25 is defined by the peripheral surface 6 of the conveyor 1 in conjunction with a suitably configurated portion of the concave surface 18 at the side 49 of the hood 17, namely that side along which successive freshly emptied flutes 2 of the conveyor 1 advance from the station C back toward the station B.

The manner of connecting suction ports (4) in the flutes of a rotary drum-shaped conveyor to a suction generating device during certain stages of each revolution of the conveyor in order to attract rod-shaped articles on their way from a first station to a second station is well known in the art of manipulating rod-shaped articles of the tobacco processing industry and need not be described here.

Figure 3:
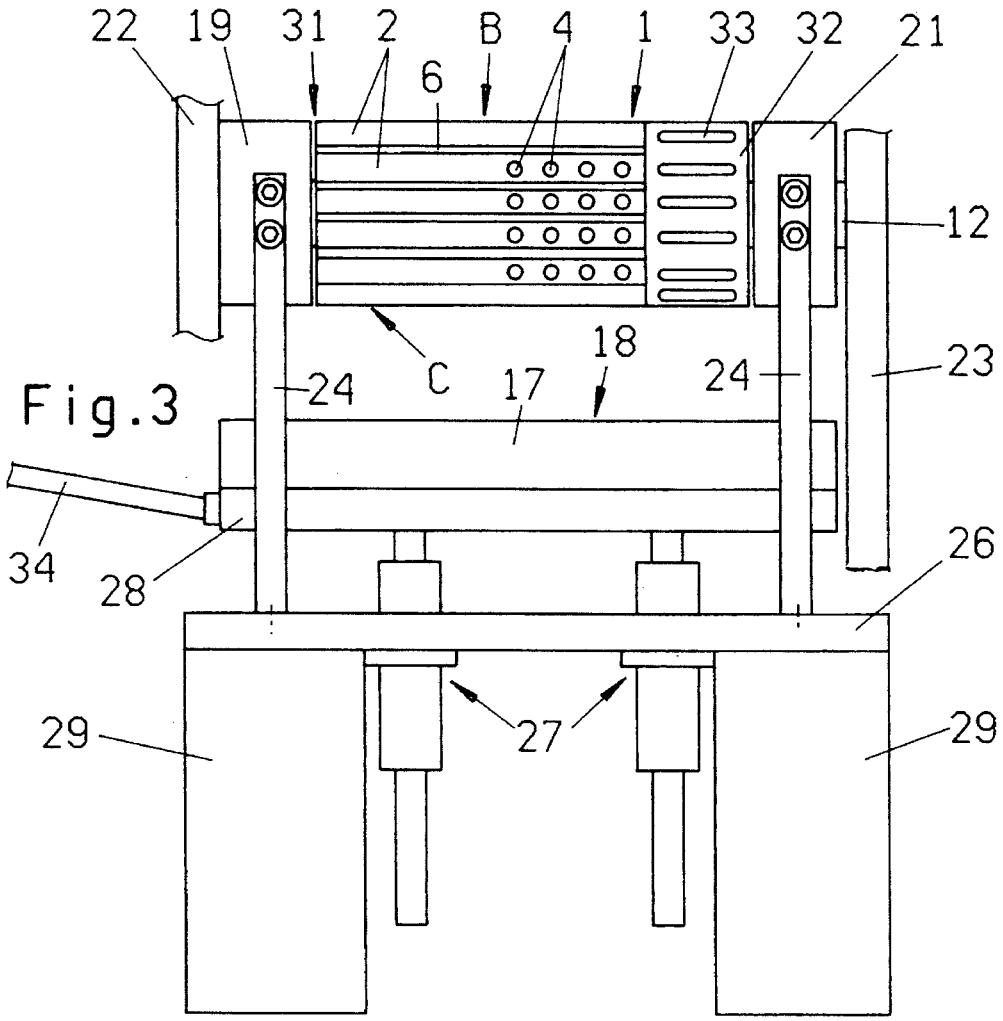
FIG. 3 is a view similar to that of FIG. 1 but with the hood shown in the second position.

The mode of operation of the improved apparatus is as follows:

It is assumed that the hood 17 and its carrier 28 dwell in the second or lower positions shown in FIGS. 3 and 4. This ensures that the hood 17 affords access to the station C, for example, to clean the flutes 2, to remove a deformed article 3, to remove a crushed article or to remove remnants of a damaged or crushed article from the inlet 46 of the pneumatic conveyor 16. When the cleaning or any other operation at the station C is completed, the pneumatic cylinder and piston units including the cylinders 29, the pistons 30 and their heads 39 are actuated to lift the carrier 28 so that the hood 17 is lifted to the position shown in FIGS. 1, 2 and 5 to 7. The upper sides of the heads 39 urge the hood 17 to move the end portions of its concave surface 18 into sealing engagement with the convex surfaces of the sealing members 19, 21 so that the median portion of the surface 18 (as seen in the direction of the axis 7) cooperates with the adjacent portion of the peripheral surface 6 to define the arcuate channel 25. The carrier 28 shares the upward movement of the hood 17 because the aforedescribed entraining means 42 enable the heads 39 of the pistons 30 to lift the carrier toward the station C. The guides 27 establish the path for vertical movements of the carrier 28 and the hood 17 thereon, i.e., the guides prevent any, or any appreciable, stray movements of the parts 17 and 28 relative to the prescribed path. The extent of play (41) between the male and female members of each entraining means 42 is selected in such a way that the sealing element 37 surronding the discharge end of the hole or bore 36 in the carrier 28 is stressed and deformed to prevent the escape of compressed air (supplied by the conduit 34) into the gap between the underside of the hood 17 and the adjacent side of the carrier 28 when the end portions of the surface 18 bear against the sealing members 19 and 21. The median portion of the hood 17 can be said to float between the carrier 28 and the adjacent portion of the peripheral surface 6 of the conveyor 1 when the upward movement of the hood is completed. The stresses which the cylinder and piston units including the parts 29, 30 and 39 apply to the sealing members 19, 21 by way of the hood 17 are taken up by the rigid columns 24 which connect the sealing members to the stationary support 26. The columns 24 also serve to counteract any bending or tilting stresses upon the sealing members 19, 21, e.g., in directions to unduly increase the width of the gaps 31 between the sealing members and the adjacent end faces of the conveyor 1. In other words, the channel or clearance 25 prevents the conveyor 1 from rubbing against the hood 17 and the gaps 31 prevent the conveyor 1 from rubbing against the sealing members 29 and 31. This ensures that the wear upon the conveyor 1 is practically nil when the apparatus is in actual use, i.e., when the hood 17 dwells in the position of FIGS. 1, 2 and 5 to 7 and the shaft 12 is driven by the motor 8.

The motor 8 normally drives the conveyor 1 at a constant speed so that the flutes 2 are orbited in the direction of the arrow 13. Each empty flute 2 which arrives at the station B can accept a discrete article from the outlet of the magazine 14 and the article is immediately attracted to the surface bounding the respective flute because, at that time, the ports 4 of such flute are connected to the suction generating device, not shown. Successive freshly filled flutes 2 advance the respective articles 3 sideways (i.e., transversely of their length) in the direction of the arrow 13 toward the station C, i.e., into positions of accurate alignment with the inlet 46 of the pneumatic conveyor 16. The pressure of air which enters a flute 2 at the station C by flowing from the conduit 34 into the bore or hole 36 and thereupon into the slot 38 and into the slot 33 at the station C suffices to propel or expel the respective article 3 into the inlet 46 while the motor 8 continues to drive the conveyor 1 in the direction of the arrow 13. The interval of time which is required to propel an article 3 at the station C in the direction of the arrow 47 is sufficiently short to permit the article to enter the conveyor 16 without any adverse effect upon its integrity. However, it is also within the purview of the present invention to drive the conveyor 1 in stepwise fashion, preferably in a manner as disclosed in the commonly owned copending patent application Ser. No. 08/271,014 filed Jul. 6, 1994 by Manfred Kaluza.

The ramp 48 constitutes a jumping platform over which the leading ends of successive articles 3 slide on their way into and beyond the inlet 46 of the pneumatic conveyor 16.

It has been found that, contrary to expectations, the establishment of permanent communication between the channel 25 and the atmosphere by way of the narrow clearances 31 contributes to a reduction of dynamic pressure and to higher output of the apparatus because the expulsion of articles 31 from successive flutes 2 into the inlet 46 of the pneumatic conveyor 16 at a high frequency is more predictable than in heretofore known apparatus. In fact, it has been ascertained that the improved apparatus can reliably expel successive articles 3 from their respective flutes 2 into the conveyor 16 at a higher frequency per unit of time than conventional apparatus.

An advantage of the enlarged downstream end (at 50) of the channel 25 is that it ensures gradual (in contrast to abrupt) escape of compressed air from successive empty flutes 2 which advance (in the direction of the arrow 13) from the station C upwardly and back toward the station B. Such gradual reduction of pressure in the empty flutes has been found to contribute to a considerable and highly desirable reduction of noise when the aforedescribed apparatus is in use.

The provision of motorized means (29, 30, 39) for moving the hood 17 and its carriage 28 between the positions of FIGS. 2 and 4 is that, when necessary, the operator or operators in charge can gain access to the station C with little loss in time.

The feature that the rotary conveyor 1 need not actually contact the hood 17 and/or the stationary sealing members 19, 21 renders it possible to not only reduce but to actually eliminate or prevent any wear upon such parts while simultaneously ensuring the transfer of rod-shaped articles at a higher frequency than in conventional apparatus.

The sealing members 19 and 21 exhibit the advantage that they cooperate with the adjacent portions of the concave surface 18 (in the raised positions of the hood 17 and its carrier 28) to ensure that the width of the channel 25 (as measured radially of the axis 7) remains unchanged after repeated movements of the hood between its raised and lowered positions. This is due to the fact that the hood 17 need not slide relative to the sealing members 19, 21 during movement toward or away from the station C as well as during periods of dwell at the station C.

The feature that the end portions of the shaft 12 are journalled in the stationary sealing members 19, 21 as well as in the stationary members 22 and 23 also contributes to the establishment of a channel 25 the dimensions of which remain unchanged after long periods of use of the improved apparatus.

The feature that the sealing members 19, 21 are reliably affixed to the stationary support 26 so that they cannot be moved in the direction and/or transversely of the axis 7 ensures that the width of the clearances 31 remains unchanged so that the conditions for pneumatic propulsion or expulsion of successive articles 3 from their respective flutes 2 into the inlet 46 of the pneumatic conveyor 16 remain unchanged during the useful life of the improved apparatus. The sealing action between the members 19, 21 and the surface 18 of the hood 17 while the hood dwells in the raised position of FIG. 1 also remains unchanged because the hood need not rub or slide relative to the sealing members and/or vice versa.

The provision of the entraining means 42 between the hood 17 and the carrier 28 renders it possible to ensure adequate stressing of the sealing element 37 and to thus prevent the escape of compressed air on its way from the source, through the conduit 34, through the bore or hole 36, through the slot 38 and into successive slots 33 at the station C. The play 41 between the heads 39 of the pistons 30 and the adjacent portions of the carrier 28 (while the upper sides of the heads 39 bear against the hood 17) renders it possible to install the sealing element 37 between the hood and the carrier 28 in at least slightly stressed condition in such a way that the element 37 can perform its sealing action in spite of the movability of the parts 17 and 28 relative to one another to the extent determined by the play 41.

The pins 43 cooperate with the entraining means 42 to ensure that the hood 17 can perform limited movements relative to the carrier 28 to an extent which guarantees that the surface 18 of the hood will engage the convex surfaces of the sealing members 19, 21 in a predictable and optimal manner upon completion of each upward movement of the pistons 30 and their heads 39 (which bear against the underside of the hood and have limited freedom of movement (at 41) relative to the carrier 28).

The aforedescribed enlargement (at 50) of the discharge or downstream end of the channel 25 constitutes but one of possible undertakings to reduce the noise during escape of compressed air from empty flutes 2 which are in the process of moving (in the direction of the arrow 13) from the station C back toward the station B. The length of the enlargement (50), as seen in the axial direction of the rotary conveyor 1, is selected in such a manner that compressed air can escape all the way from one end toward the other end of each flute 2 which advances toward the station B.

The apparatus of the present invention can be utilized for the transport of a wide variety of rod-shaped articles from a source of supply wherein the articles are stacked upon and are parallel to each other toward a pneumatic conveyor wherein the articles are propelled axially one behind the other. As already mentioned above, the apparatus can be utilized with particular advantage for the transport or transfer of rod-shaped articles of the tobacco processing industry which must be treated gently in order to avoid deformation, tearing, crushing, smudging or other defects which would lead to expulsion of defective articles from the path or paths for satisfactory articles. For example, the apparatus can be utilized in filter rod feed systems of the type known as FILTROMAT which are produced and distributed by the assignee of the present application.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for transferring rod-shaped articles from a source of parallel articles into a pneumatic conveyor, said apparatus comprising:

a second conveyor rotatable about a predetermined axis and having a peripheral surface provided with a plurality of article receiving flutes parallel to said axis, said second conveyor having first and second end faces flanking said peripheral surface and first and second stationary sealing members closely adjacent to but being out of contact with the respective end faces;

means for rotating said second conveyor to thus repeatedly advance successive flutes between a first station where the flutes receive discrete articles from an outlet of said source and a second station where the flutes register with an inlet of said pneumatic conveyor, said rotating means including a shaft which is coaxial with and carries said rotary conveyor and is journalled in at least one of said sealing members;

means for propelling articles lengthwise from successive flutes at said second station into said inlet;

a hood having a second surface complementary to a portion of said peripheral surface; and means for moving said hood between a first position in which said second surface is closely adjacent to but out of contact with said peripheral surface at said second station and a second position in which said hood affords access to said second station, said second surface having portions sealingly engaging said sealing members in the first position of said hood.

2. The apparatus of claim 1, wherein said first station is located at a level above said second station and said peripheral surface is located at a level above said second surface, at least in the second position of said hood.

3. The apparatus of claim 1, wherein said second surface is a concave surface and each of said sealing members has a convex third surface which is engaged by the respective portion of said second surface in the first position of said hood, said second and third surfaces having at least substantially identical radii of curvature and said peripheral surface having a radius of curvature smaller than the radius of curvature of said second surface.

4. The apparatus of claim 1, wherein said means for moving comprises at least one piston movable substantially radially of said axis to bias said portions of said second surface against said sealing members in the first position of said hood, said at least one piston being disposed at said sealing members.

5. The apparatus of claim 4, wherein said propelling means comprises a pneumatic ejector and said moving means further comprises a carrier interposed between said hood and said at least one piston, said ejector having a portion disposed in said carrier.

6. The apparatus of claim 5, further comprising elastic sealing means interposed between said carrier and said hood.

7. The apparatus of claim 5, further comprising complementary first and second entraining members respectively provided on said at least one piston and said carrier, one of said entraining members extending with clearance into the other of said entraining members.

8. The apparatus of claim 1, further comprising a stationary support and means for fixedly securing said sealing members to said support, said means for moving including at least one fluid-operated motor mounted on said support and comprising a reciprocable piston for said hood.

9. The apparatus of claim 8, wherein said at least one motor includes a pneumatic cylinder and piston unit.

10. The apparatus of claim 1, wherein said moving means includes a carrier for said hood, means for reciprocating said carrier, a support for said reciprocating means, and at least one guide provided on said support and establishing a path for movements of said carrier toward and away from said second station.

11. The apparatus of claim 10, wherein said path is a substantially vertical path.

12. The apparatus of claim 1, wherein said means for moving includes means for confining said hood to movements along a substantially vertical path.

13. The apparatus of claim 1, wherein said means for moving comprises a carrier for said hood and means for maintaining said hood in a predetermined position relative to said carrier.

14. The apparatus of claim 1, wherein said source is adapted to contain filter rod sections.

15. The apparatus of claim 1, wherein said rotary conveyor includes means for pneumatically attracting rod-shaped articles in the flutes advancing from said first station toward said second station.

16. Apparatus for transferring rod-shaped articles from a source of parallel articles into a pneumatic conveyor, said apparatus comprising:

a second conveyor rotatable about a predetermined axis and having a peripheral surface provided with a plurality of article receiving flutes parallel to said axis, said second conveyor having a sealing member closely adjacent to but being out of contact with an end face of said second conveyor;

means for rotating said second conveyor to thus repeatedly advance successive flutes between a first station where the flutes receive discrete articles from an outlet of said source and a second station where the flutes register with an inlet of said pneumatic conveyor;

means for propelling articles lengthwise from successive flutes at said second station into said inlet;

a hood having a second surface complementary to a portion of said peripheral surface; and means for moving said hood between a first position in which said second surface is closely adjacent to but out of contact with said peripheral surface at said second station and a second position in which said hood affords access to said second station, said sealing member having a third surface which is sealingly engaged by a portion of said second surface in the first position of said hood, said inlet being provided in said sealing member and further comprising a ramp provided on said hood to guide successive articles arriving at said second station into said inlet in the first position of said hood.

17. The apparatus of claim 16, wherein said ramp is recessed into said second surface.

18. Apparatus for transferring rod-shaped articles from a source of parallel articles into a pneumatic conveyor, said apparatus comprising:

a second conveyor rotatable about a predetermined axis and having a peripheral surface provided with a plurality of article receiving flutes parallel to said axis;

means for rotating said second conveyor in a predetermined direction to thus repeatedly advance successive flutes between a first station where the flutes receive discrete articles from an outlet of said source and a second station where the flutes register with an inlet of said pneumatic conveyor;

means for propelling articles lengthwise from successive flutes at said second station into said inlet;

a hood having a second surface complementary to a portion of said peripheral surface; and means for moving said hood between a first position in which said second surface is closely adjacent to but out of contact with said peripheral surface at said second station and a second position in which said hood affords access to said second station said peripheral surface of said second conveyor and said second surface of said hood defining, in the first position of said hood, an arcuate channel having an upstream end and an enlarged downstream end arranged to permit air to escape from successive flutes advancing from said second station toward said first station.

* * * * *